US006065503A

United States Patent [19]

Berktold et al.

[11] Patent Number: 6,065,503

[45] Date of Patent: May 23, 2000

[54] APPARATUS FOR CHANGING THE BEAT-UP POSITION OF A REED

[75] Inventors: Klaus Berktold, Rüti; Ernst Eberhard, Dürnten, both of Switzerland

[73] Assignee: Sulzer Rueti AG, Rueti, Switzerland

[21] Appl. No.: 09/085,710

[22] Filed: May 27, 1998

[30] Foreign Application Priority Data

Jul. 17, 1997 [EP] European Pat. Off. ..... 97810502

[51] Int. Cl.[7] ..... D03D 39/22

[52] U.S. Cl. ..... 139/26; 139/189

[58] Field of Search ..... 139/26, 27, 191, 139/189

[56] References Cited

U.S. PATENT DOCUMENTS

| | | | |
|---|---|---|---|
| 2,514,603 | 7/1950 | Haney . | |
| 4,566,498 | 1/1986 | Williams . | |
| 5,058,628 | 10/1991 | Spiller et al. | 139/25 |
| 5,199,466 | 4/1993 | Corain | 139/27 |
| 5,499,662 | 3/1996 | Vogel et al. | 139/26 |
| 5,518,037 | 5/1996 | Takahashi et al. | 139/26 |

FOREIGN PATENT DOCUMENTS

| | | |
|---|---|---|
| 0 350 446 A1 | 1/1990 | European Pat. Off. . |
| 25 07 478 | 8/1976 | Germany . |
| 26 56 081 | 6/1977 | Germany . |
| 7-292544 | 7/1995 | Japan . |
| 2 276 889 | 10/1994 | United Kingdom . |

*Primary Examiner*—Andy Falik

*Attorney, Agent, or Firm*—Townsend and Townsend and Crew LLP

[57] ABSTRACT

An apparatus for changing the beat-up positions of a reed in a weaving machine. The apparatus includes a drive, a drive member, a transmission and a kinematic chain. The kinematic chain is connected to the transmission and the pivot axle for the reed, with the pivot axle being pivotally mounted on the sley sword. A basic movement is imparted by the drive to the apparatus with the beat-up position of the pivot axle of the reed being changed by the drive member.

6 Claims, 4 Drawing Sheets

APPARATUS FOR CHANGING THE BEAT-UP POSITION OF A REED

BACKGROUND OF THE INVENTION

1. Field of the Invention

The invention relates to an apparatus for changing the beat-up position of a reed in a weaving machine, in particular, in a terry weaving machine and to a weaving machine with an apparatus of this kind.

2. Description of the Prior Art

A terry weaving machine with an apparatus for changing the beat-up position of a reed is disclosed in EP-A-0 350 446. Two complementary cam curves are arranged on the main drive shaft of the weaving machine. The sley sword is formed as a roller lever with two rollers. The roller lever is arranged on the sley tube axle and in contact with the complementary cam curves in order to impart a basic movement to the sley sword. The sley with the reed is likewise arranged on the sley tube axle and connected drivewise to the sley sword via the apparatus for changing the beat-up positions. This apparatus contains a control disc or cam, a servo-motor with a transmission which is in engagement with the control disc, a crank lever with rollers, a sliding block which is pivotally connected thereto and a lug with a guide for the sliding block. The sley and the lug are connected to one another.

A disadvantage of this apparatus proves to be the large number of individual parts, which influences the manufacturing costs.

SUMMARY OF THE INVENTION

The object of the invention is to improve an apparatus for changing the beat-up position.

DETAILED DESCRIPTION OF THE PREFERRED EXEMPLARY EMBODIMENTS

Figure 2:
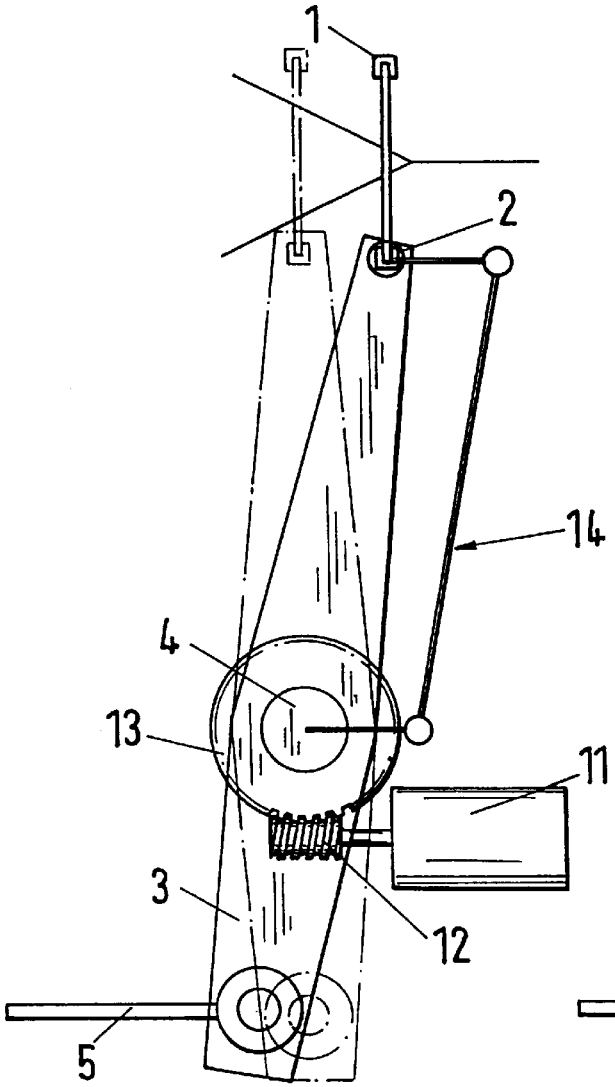
FIG. 2 is an elevation view of the reed drive apparatus in the position of a partial beat-up with the embodiment of FIG. 1.
Figure 1:
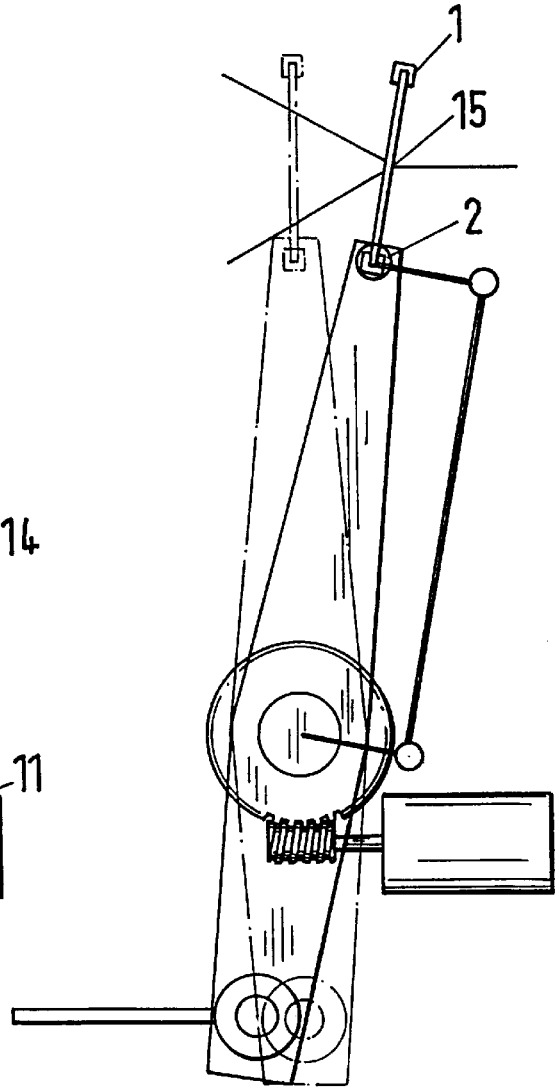
FIG. 1 is an elevation view of a reed drive apparatus in the position of full beat-up with a first embodiment of an apparatus in accordance with the invention.

Reference is made to FIGS. 1 and 2. A sley of a terry-cloth weaving machine contains a reed 1 with a reed pivot axle 2, a number of sley swords 3, an axle 4 for the sley swords and a drive 5 for the sley swords in order to impart a basic movement to the sley swords. The reed 1 and the reed pivotal axle 2 are pivotally arranged at the sley swords 3.

The first embodiment of the apparatus in accordance with the invention comprises a servo-motor 11 with a worm 12 which is arranged at a fixed location, a worm wheel 13 which is arranged rotatably on the axle 4 and is in engagement with the worm and a four bar linkage 14 in order to connect the worm wheel 13 to the pivot axle 2 of the reed. In the illustration of FIG. 1 the reed 1 has performed a full beat-up and abuts against the cloth edge 15. For the execution of a partial beat-up the beat-up position of the reed 1 can be changed for each individual weft insertion. As can be seen from the illustration of FIG. 2, the reed 1 is pivoted. This pivoting of the reed is performed by the servo motor 11. The rotational movement of the gear 13 can be done in any manner desired, i.e. with all kinds of transmissions and motors, e.g. also hydraulically or pneumatically or with a linear motor.

Figure 3:
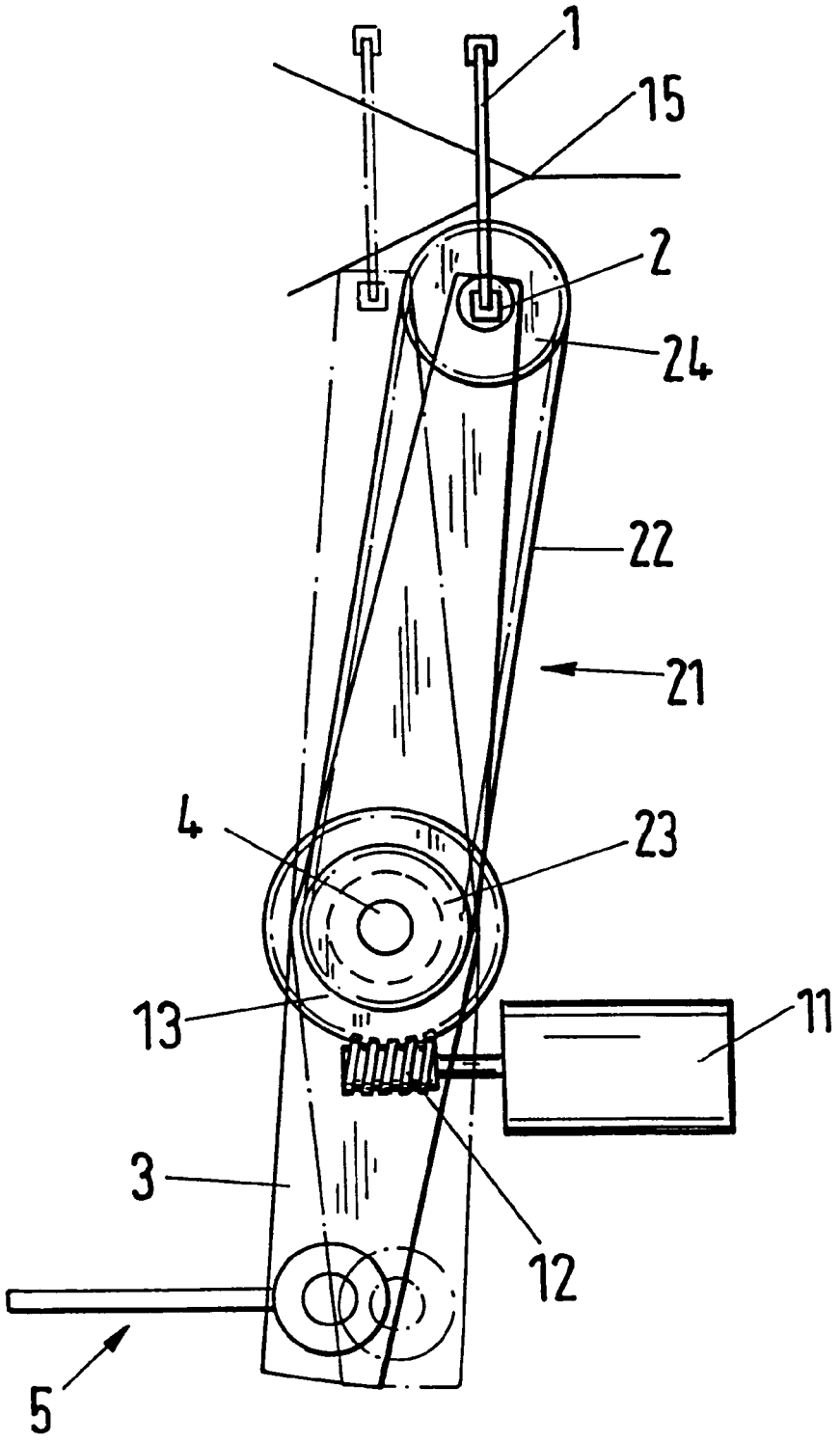
FIG. 3 is an elevation view of the reed drive apparatus in the position of a partial beat-up with a second embodiment.

The embodiment of FIG. 3 differs from the above described ones in that a belt drive 21 with a toothed belt 22 is provided instead of the four bar linkage, with a toothed wheel 23 being connected to the worm gear 16 and the other toothed wheel 24 being connected to the pivot axle for the reed. It is pointed out that a chain drive is likewise suitable.

Figure 4:
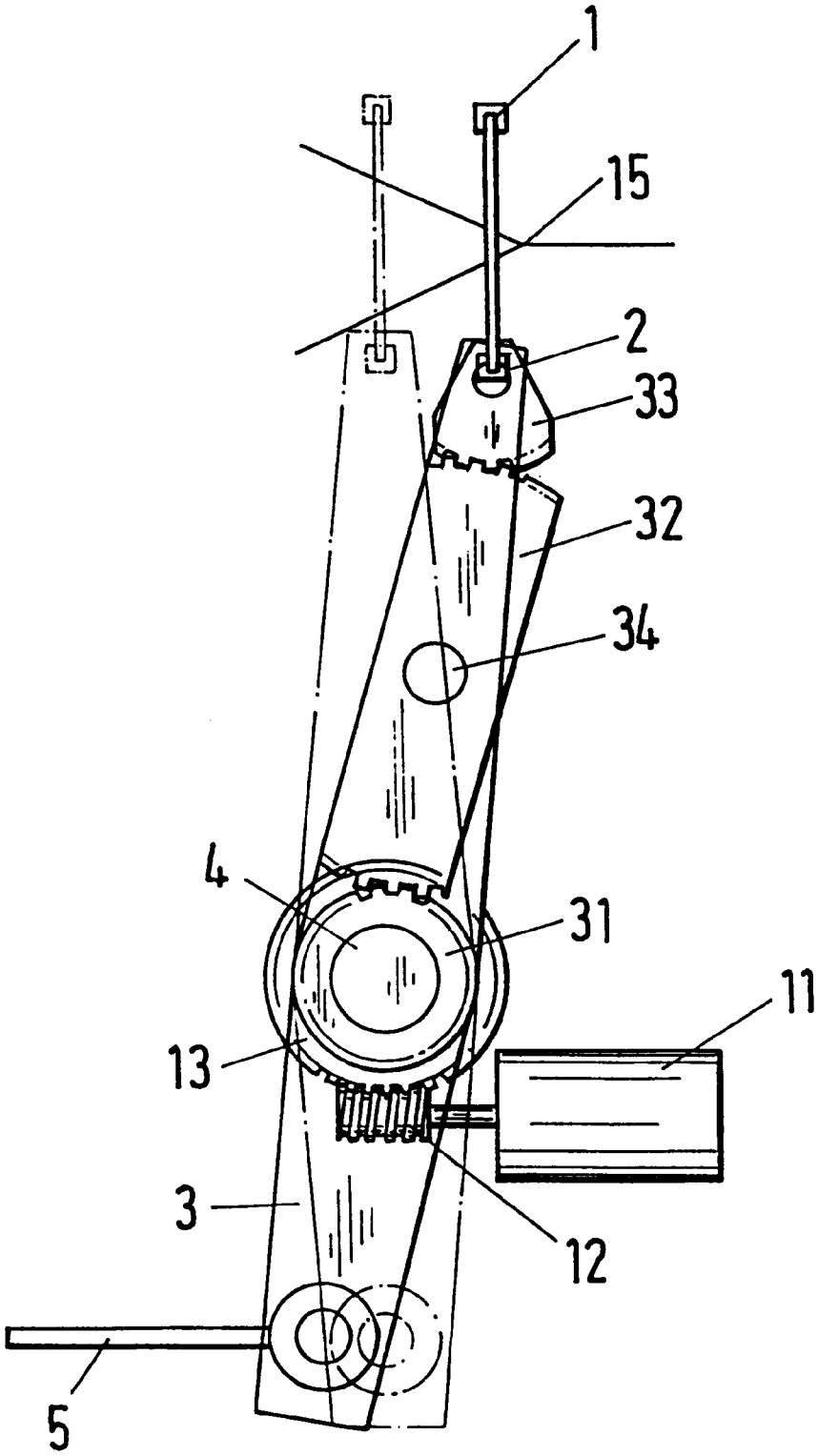
FIG. 4 is an elevation view of the reed drive apparatus in the position of a partial beat-up with a third embodiment and FIG. 5 is an elevation view of a modified first embodiment of the reed drive apparatus in the position of a partial beat-up.

In the embodiment of FIG. 4 a gear 31, a toothed intermediate member 32 and a toothed segment 33 are provided as transmission elements. The gear 31 is firmly connected to the worm gear 13, which is rotatably arranged on the axle 4. The intermediate member 32 is rotatably arranged on the axle 34, which is mounted on the sley sword 3. The toothed segment 33 is mounted on the pivot axle 2 for the reed, which is rotatably arranged on the sley sword 3.

Figure 5:
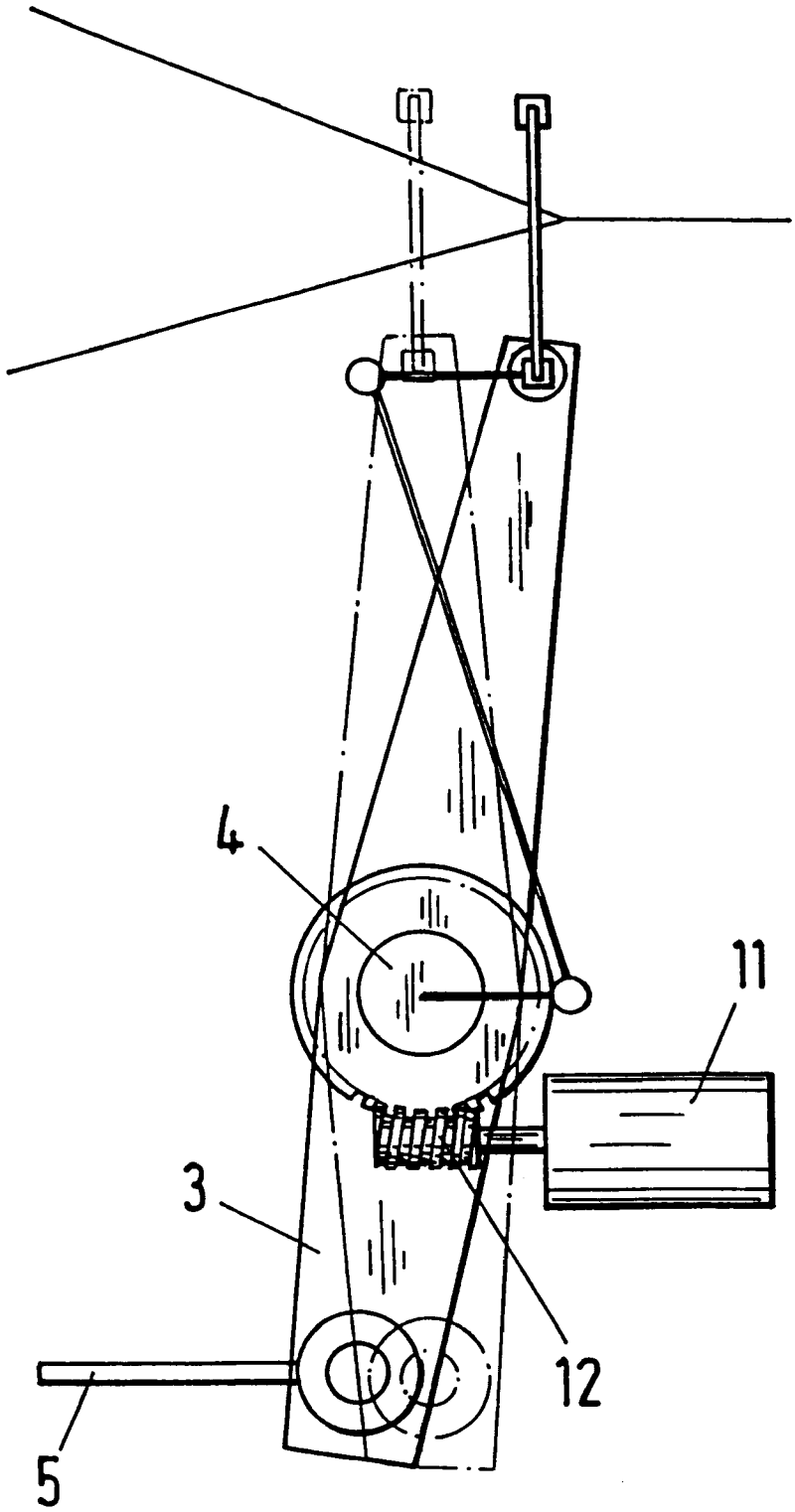

FIG. 5 shows another embodiment of the kinematic chain.

In the above described embodiments the pivotal movement can be done selectively during the back and forth movement or in the rear reversal position or in the reversal position of the beat-up side.

The apparatus is mounted on a sley sword 3 to which a basic movement is imparted by a drive 5 and which comprises a drive member 11, a transmission 12, 13 and a kinematic chain 14. The four bar linkage is connected, on the one hand, to the transmission and, on the other hand, to the pivot axle 2 for the reed, the axle 2 being pivotally mounted on the sley sword 3. The beat-up position of the pivot axle 2 for the reed is changed by the drive member 11. The advantage of the apparatus consists in the simple and compact construction.

What is claimed is:

1. An apparatus for changing the beat-up position of a reed in a weaving machine comprising a plurality of sley swords that include a pivot axle, the apparatus comprising an electric drive member which is connected via a transmission and/or transmission elements to the pivot axle of the sley swords, with the transmission elements forming a kinematic chain to the reed and being arranged on a corresponding one of the sley swords.

2. An apparatus for changing the beat-up position of a reed in a weaving machine comprising a plurality of sley swords, the apparatus comprising an electric drive member which is connected via a transmission and/or transmission elements to a pivot axle of the reed, with the transmission elements being formed as a belt drive arranged on a corresponding one of the sley swords.

3. An apparatus for changing the beat-up position of a reed in a weaving machine comprising a plurality of sley swords that include a pivot axle, the apparatus comprising an electric drive member which is connected via a transmission and/or transmission elements to the pivot axle of the sley swords, with the transmission elements having a gear, at least one intermediate wheel and a tooth segment all arranged on a corresponding one of the sley swords.

4. A weaving machine comprising a sley with a main drive, a reed having a pivot axle, sley swords that include a pivot axle and are connected to a reed pivotal axle and to the main drive in order to impart a basic movement to the sley and an apparatus for changing the beat-up position of the reed, the apparatus comprising:

an electric drive member which is connected via a transmission and/or transmission elements to the pivot axle of the sley swords, with the transmission elements forming a kinematic chain arranged on a corresponding one of the sley swords.

5. A weaving machine comprising a sley with a main drive, a reed having a pivot axle, sley swords that are connected to the reed pivotal axle and to the main drive in order to impart a basic movement to the sley and an apparatus for changing the beat-up position of the reed, the apparatus comprising:

an electric drive member which is connected via a transmission and/or transmission elements to a pivot axle of the reed, with the transmission elements being formed as a belt drive arranged on a corresponding one of the sley swords.

6. A weaving machine comprising a sley with a main drive, a reed having a pivot axle, sley swords that include a pivot axle and are connected to the reed pivotal axle and to the main drive in order to impart a basic movement to the sley and an apparatus for changing the beat-up position of the reed, the apparatus comprising:

an electric drive member which is connected via a transmission and/or transmission elements to the pivot axle of the sley swords, with the transmission elements having a gear, at least one intermediate wheel and a tooth segment all arranged on a corresponding one of the sley swords.

* * * * *